US010066788B2

(12) United States Patent
Cipriani et al.

(10) Patent No.: US 10,066,788 B2
(45) Date of Patent: Sep. 4, 2018

(54) COOLING OF A DEWAR VESSEL WITH ICE FREE COOLANT AND FOR SHORT SAMPLE ACCESS

(71) Applicant: EUROPEAN MOLECULAR BIOLOGY LABORATORY, Heidelberg (DE)

(72) Inventors: Florent Cipriani, Claix (FR); Franck Felisaz, St. Egrève (FR)

(73) Assignee: EUROPEAN MOLECULAR BIOLOGY LABORATORY, Heidelberg (DE)

( * ) Notice: Subject to any disclaimer, the term of this patent is extended or adjusted under 35 U.S.C. 154(b) by 470 days.

(21) Appl. No.: 14/417,174

(22) PCT Filed: Jul. 26, 2013

(86) PCT No.: PCT/EP2013/065788
§ 371 (c)(1),
(2) Date: Jan. 26, 2015

(87) PCT Pub. No.: WO2014/016404
PCT Pub. Date: Jan. 30, 2014

(65) Prior Publication Data

US 2015/0211682 A1 Jul. 30, 2015

(30) Foreign Application Priority Data

Jul. 27, 2012 (EP) ..... 12178272

(51) Int. Cl.
*F04B 9/10* (2006.01)
*F04B 19/24* (2006.01)
(Continued)

(52) U.S. Cl.
CPC ..... *F17C 3/085* (2013.01); *F04B 23/02* (2013.01); *F04B 23/021* (2013.01); *F17C 6/00* (2013.01);
(Continued)

(58) Field of Classification Search
CPC ..... F17C 2227/0374; F17C 2227/0393; F17C 2227/0395; F17C 2227/048;
(Continued)

(56) References Cited

U.S. PATENT DOCUMENTS 3,025,680 A 3/1962 De Brosse et al.
3,898,853 A * 8/1975 Iung ..... F17C 7/02 137/210

(Continued)

FOREIGN PATENT DOCUMENTS

DE 100 39 214 A1 2/2002
JP 6-188465 A 7/1994

*Primary Examiner* — Frantz Jules
*Assistant Examiner* — Erik Mendoza-Wilkenfe
(74) *Attorney, Agent, or Firm* — Birch, Stewart, Kolasch & Birch, LLP

(57) ABSTRACT

The present invention relates to a pump (15) for pumping a coolant (9) within a Dewar vessel (1) and to a corresponding Dewar vessel (1) for storing samples in a coolant (9). The Dewar vessel (1) comprises a thermally insulated reservoir (3) for the coolant (9) and a sample vessel (11) provided separately and arranged in the thermally insulated reservoir (3). The reservoir (3) is connected to the sample vessel (11) in such a way that the level of coolant (9) is constant in the sample vessel (11). Pump (15) may help in keeping the level of coolant (9) in the sample vessel (11) constant. For this purpose the pump (15) comprises a chamber (17) with an inlet (19) and an outlet (21), a closing element (23) and a pressure increasing device (25). Therein, the inlet (19) is connectable to the reservoir (3) and the outlet (21) is connectable to a sample vessel (11) of the Dewar vessel (1).

(Continued)

The chamber (17) is adapted to fill with coolant (9) through the inlet (19) by gravity and the closing element (23) is adapted to automatically close the chamber (17) when it is full of coolant (9). The pressure increasing device (25) is adapted to increase the pressure within the chamber (17), after the chamber (17) is closed, until the coolant (9) is released through the outlet (21).

7 Claims, 2 Drawing Sheets

(51) Int. Cl.

| | |
|---|---|
| ***F25B 9/00*** | (2006.01) |
| ***F17C 3/00*** | (2006.01) |
| ***F17C 13/06*** | (2006.01) |
| ***F17C 13/10*** | (2006.01) |
| ***F25D 21/00*** | (2006.01) |
| ***F17C 3/08*** | (2006.01) |
| ***F04B 23/02*** | (2006.01) |
| ***F25D 3/10*** | (2006.01) |
| ***F17C 6/00*** | (2006.01) |
| *F25D 21/06* | (2006.01) |

(52) U.S. Cl.
CPC ..... *F17C 13/06* (2013.01); *F17C 13/10* (2013.01); *F25D 3/10* (2013.01); *F25D 21/00* (2013.01); *F25D 3/102* (2013.01); *F25D 21/065* (2013.01); *F25D 2400/02* (2013.01); *F25D 2500/02* (2013.01)

(58) Field of Classification Search
CPC ..... F17C 2250/0408; F17C 2250/0413; F17C 2250/0417; F17C 2250/0626; F17C 2227/03; F17C 2227/032; F17C 2227/0304; F17C 2270/0509; F17C 3/085; F17C 6/00; F17C 13/06; F17C 13/10; F04B 9/10; F04B 9/1056; F04B 19/24; F04D 13/08; F04D 13/086; Y10T 137/053; F25D 21/00; F25D 3/102; F25B 9/00
USPC ..... 417/150, 208, 292, 297.5; 137/614.2
See application file for complete search history.

(56) References Cited

U.S. PATENT DOCUMENTS

| | | | | |
|---|---|---|---|---|
| 4,292,062 | A * | 9/1981 | Dinulescu ..... | B60K 15/013 62/240 |
| 4,566,283 | A | 1/1986 | Boese | |
| 4,852,357 | A | 8/1989 | Porter | |
| 2009/0129946 | A1 | 5/2009 | Toubia et al. | |
| 2014/0169993 | A1* | 6/2014 | Berzak ..... | B01D 8/00 417/401 |

* cited by examiner

COOLING OF A DEWAR VESSEL WITH ICE FREE COOLANT AND FOR SHORT SAMPLE ACCESS

FIELD OF THE INVENTION

The present invention relates a Dewar vessel. In particular, the present invention relates to a pump for pumping a coolant for a Dewar vessel and to a Dewar vessel for storing samples in a coolant. Furthermore, the invention relates to a method for producing a pump for pumping a coolant for a Dewar vessel and to a method for producing a Dewar vessel for storing samples in a coolant.

BACKGROUND OF THE INVENTION

Dewar vessels, also denoted as Dewar flasks, are containers designed to provide a good thermal insulation. On the one hand, Dewar vessels are used as Thermos bottles for keeping beverages hot. On the other hand, Dewar vessels may be employed in laboratories to keep samples cool.

Usually, the samples have to be stored at or near the bottom of the Dewar vessel to provide an optimal cooling and to ensure that the sample is covered by a coolant such as liquid nitrogen. This may complicate the handling of the samples and make a high throughput access difficult.

Furthermore, to prevent ice contamination of the coolant by the water vapour contained in the ambient air Dewars are usually closed by a lid. High throughput sample access then requires opening the Dewar frequently, thus resulting in ice contamination of the coolant.

SUMMARY OF THE INVENTION

Thus, there may be a need for a possibility to provide a reliable cooling of samples and at the same time to provide an easy access to the samples, as well as for a possibility to keep the Dewar open while minimizing the amount of ice in the coolant.

Those needs may be covered by the subject-matter of the independent claims. Further exemplary embodiments are evident from the dependent claims and the following description.

According to a first aspect of the present invention a pump for pumping a coolant in a Dewar vessel is provided. The pump comprises a chamber, a closing element and a pressure increasing device. The chamber comprises an inlet and an outlet and is adapted to fill automatically by gravity flow through the inlet. Therein, the inlet of the chamber is connectable to a coolant reservoir of the Dewar vessel and the outlet of the chamber is connectable to a sample vessel of the Dewar vessel. The closing element is adapted to automatically close the chamber by floating when the chamber is filled by coolant. Additionally or alternatively the closing element may close the inlet automatically due to a stepwise pressure increase inside the chamber produced by the pressure increasing device. Furthermore, the pressure increasing device is adapted to increase the pressure within the chamber after the chamber is partly or totally filled with the coolant, and until part of or all of the fluid is released through the outlet.

In other words, the idea of the present invention according to the first aspect is based on providing a mechanically simple pump for a Dewar vessel which contains no complicated moving mechanical parts and operates simply, i.e. the pump may be called pseudo static. Due to the simple design and functionality of the pump it may be integrated directly into the Dewar vessel and does not require a lot of maintenance or service. The pump may provide the required amount of coolant such as liquid nitrogen to an upper part of a Dewar vessel such that samples may be stored near an opening at the top of the Dewar vessel and still be sufficiently immersed into the coolant. Therein, the coolant may be set to a constant level in the Dewar, in particular a sample vessel of the Dewar. Furthermore, the coolant may be recycled and cleaned internally.

Advantageously, due to the simple construction of the pump, it does not require excessive connections to the outside of the Dewar vessel. For example, the pump may be connected to the external world only by way of a few electrical wires or by a single pneumatic line.

Furthermore, the pump may have a pseudo volumetric operation. I.e. the amount of coolant delivered or conveyed with one operational cycle of the pump into the region of the samples is essentially constant over the cycles. This amount may correspond to the volume of the chamber of the pump, or may be smaller. Therein, the amount of the coolant conveyed to the samples, i.e. to the sample vessel may e.g. be controlled by an amount of heat delivered to the coolant within the pump or by a volume of gas injected into the chamber of the pump, as explained in detail below.

Moreover, due to the simple design of the pump its size may be easily varied and adapted to the requirements of each respective Dewar vessel. A further advantage of the pump is that it possibly may be produced at low cost.

Therein, the pump pumps the coolant within the Dewar vessel. Thus, the coolant is not pumped to an external location as in known applications, but is recirculated within the Dewar vessel. Particularly, the coolant is provided to an upper part of a Dewar vessel such that samples may be stored near an opening at the top of the Dewar vessel and still be sufficiently immersed into the coolant.

The chamber of the pump may comprise a predefined volume with a housing. The housing may comprise materials such as metal and/or synthetic material. The inlet may for example be provided at an upper part or at the top of the chamber. This may enhance the filling of the chamber by gravity flow and make possible the operation of the closing element. The outlet may be provided at a lower part or at the bottom of the chamber. Alternatively, the outlet may be provided in a side wall or at the top the chamber. Preferably, the inlet is provided at the top of the chamber such that the coolant flows downwards by gravity into the chamber. In this case the chamber may fill faster as compared to when the inlet is provided at the bottom of the chamber and the coolant has to flow into the chamber against the hydrostatic pressure of the fluid already present in the chamber. Particularly, with an inlet at the bottom of the chamber the chamber may not fill at all if the gas within the chamber is not evacuated or, e.g. has no way of leaving the chamber. In addition to providing the inlet at the top of the chamber an evacuating device may be incorporated into the inlet or into a valve provided at the inlet. This may enhance a proper and fast evacuation of the gas.

The pump is designed for placement within a Dewar vessel, in particular, within a coolant reservoir of a Dewar vessel. Therein, the coolant may for example be liquid nitrogen. The inlet of the chamber may be connected to the coolant reservoir and the outlet of the chamber may be connected to a sample vessel of the Dewar vessel.

The closing element may be designed as a floating element (i) or for example as a large surface non-return valve (ii). The closing element may be normally opened e.g. by gravity in case of a floating element (i) or by a low force spring in case of a non-return valve (ii). Furthermore, the closing element may be closed by a fast pressure increase in the chamber created by the pressure increasing device.

When the pump is empty the inlet is open in case of the floating element (i) because it is not floating. Therein, the floating element comprises a material which has a lower density as the coolant. Particularly, the closing element is made of a material which has a lower density than liquid nitrogen, such that it swims on top of the liquid nitrogen when it is filled into the chamber. Furthermore, if the closing element is designed as a non-return valve (ii), the inlet is kept open by gravity or by the low force spring. A guiding rail or guiding rod may be provided within the chamber for guiding the closing element. I.e. the movability of the closing element may be restricted to one dimension within the chamber. For example the closing element may move along the guiding rod from the bottom of the chamber to the inlet of the chamber.

When the pump is positioned within the coolant or immersed at least partially into the coolant within the Dewar vessel, the chamber fills automatically with coolant due to gravity. Therein, the pump is positioned within the coolant in such a way that the inlet is immersed into the coolant. The closing element floats at the top of the coolant and closes the inlet when the chamber is filled in case of a design as a floating element (i). Alternatively, the closing element closes when a fast pressure increase in the chamber is created by the pressure increasing device in case of a design as a non-return valve (ii). Thus, the closing element closes automatically when the chamber is filled with coolant, i.e. the closing functionality of the closing element only directly depends on the fill level of the chamber and is realized as soon as a certain fill level is reached.

According to a further alternative, the closing element may be an active valve driven by an electro magnet or driven mechanically. I.e. the closing element may be actuable by a driving unit which is electrically connected to the active valve. Furthermore, the closing element may be actuated by a mechanical connection, e.g. manually or automatically. The mechanical connection may for example be provided from the top of the Dewar vessel, e.g. as a rod coupled to the active valve.

After the chamber is filled a pressure increasing device is activated to increase the pressure within the chamber. Therein, the pressure increasing device may for example be adapted to increase the pressure indirectly by heating or directly by compressing the content of the chamber. In particular, the pressure increasing device may be a low thermal inertia heating element such as a wire with a high resistance. Alternatively, the pressure increasing device may be a gas pump, e.g. a piston pump connected to the chamber via a tube.

The pressure increasing device increases the pressure until it is high enough to overcome a restricting element at the outlet of the chamber. Therein, the restricting element may for example be a non-return valve or a restrictor, e.g. a throttle valve. The coolant contained in the chamber is than released or ejected via a line to the sample vessel of the Dewar vessel. The pressure is preferably increased in a "flash" such that most of the coolant is released from the chamber before the inlet is opened. After the emptying of the chamber, the closing element sinks and the inlet opens again such that the pump cycle, also denoted as "stroke" may be repeated. The cycle may be repeated continuously such that the sample vessel of the Dewar is filled continuously with fresh ice free coolant. This again allows to position the sample vessel near an opening of the Dewar vessel where the samples are easily accessible for manual transfer and may be manipulated at a high rate by robotized systems.

According to an embodiment of the present invention the pressure increasing device is a resistor which is adapted for heating the coolant to increase the pressure within the chamber by evaporating part of the coolant. Particularly, the resistor may be a resistive wire, i.e. a wire with a high resistance in which a part of the electric energy provided to the wire is transformed into heat. The resistor may be designed to have a large surface. For example, the resistor may be designed with several coils or windings. Furthermore, the resistor may comprise a meandering shape.

Therein, the resistor is arranged within the chamber and is in direct contact with the coolant within the chamber. Moreover, the resistor is connected to an energy source such as a voltage supply. The energy source may be arranged outside the pump and possibly outside the Dewar vessel. The resistor may be connected to the energy source by at least one electrical line, which e.g. may comprise two wires.

The resistor is supplied with energy after the inlet of the pump is closed by the closing element. Therein, closed may denote completely closed or almost closed. If for example, the closing element is designed as a floating element, the resistor may be supplied with energy after the inlet is actually closed. However, if the closing element is designed as a non-return valve with a large surface, the resistor may be supplied with energy after the fill level in the chamber reaches a certain level and the non-return valve is in the vicinity of the inlet. In this case the non-return valve closes the outlet after the pressure is increased, due to a dynamic difference of pressure.

The electric energy supplied is transformed into heat at the resistor. The heat is conveyed directly to the coolant in the chamber. Part of the coolant evaporates which leads to a fast pressure increase which displaces the coolant from the chamber of the pump into the sample vessel. Therein, in the case of liquid nitrogen a little amount of evaporated nitrogen is enough to create sufficient pressure to open the outlet of the chamber.

According to a further embodiment of the present invention the pressure increasing device is a piston pump. The piston pump may be arranged outside the chamber and possibly outside the pump and outside the Dewar vessel. Therein, the piston pump is connected to the chamber by a small diameter pneumatic tube and can operate at room temperature. The piston pump is thus adapted for use with the Edge Dewar described below. However, the piston pump may also be replaced by other types of pumps or by a pressurized gas supplies in combination with a vane.

According to a further embodiment of the present invention the pressure increasing device is a gas supply possibly in combination with a control valve. For example a Nitrogen gas or dry air may be supplied to the chamber by the pressure increasing device. The Nitrogen gas or dry air supply may be connected to the pump via a control valve. The Nitrogen gas or the dry air may be supplied to the chamber at a pressure of about 1 bar.

According to a further embodiment of the present invention the pump further comprises a control device which is adapted for activating the pressure increasing device, independently from a fill level in the chamber, in predefinable intervals of time. For example, the automatic filling of the chamber may take about 10 seconds. And the pressure increasing and ejecting of the coolant may take about 5 seconds. Thus, the control device may activate the pressure increasing device in intervals of 15 seconds. In this case no fill level sensors are necessary. The times necessary for a pump cycle may depend on the volume of the chamber, the size of the inlet and the volume per stroke. Thus, these times may vary from a few seconds to minutes.

According to a further embodiment of the present invention the pump further comprises a control device which is adapted for determining a fill level in the chamber. Therein, the control device is adapted to activate the pressure increasing device after the determined fill level in the chamber reaches a certain predefinable fill level value. The control device may for example be a central control unit (CPU) and may be electrically and/or functionally connected to the closing element, to a fill level sensor and/or to the pressure increasing device. The predefinable or predefined fill level value may for example be stored on a memory of the control device.

According to a further embodiment of the present invention the pump further comprises a fill level sensor. The fill level sensor may for example be designed as a contact sensor and be arranged at or near the inlet of the chamber. For example, the fill level sensor may be arranged at the closing element. Therein, the fill level sensor is adapted to determine the fill level in the chamber and to transmit the fill level to the control device. The control device compares the determined value with a predefinable value and activates the pressure increasing device as soon as the fill level reaches the predefinable value. The employment of fill level sensors may be helpful in optimizing the pumping cycle and/or in monitoring the operation of the pump.

An additional sensor located in the overflow e.g. at the upper edge of the sample vessel may be employed for monitoring the operation of the pump. The additional sensor or possibly several additional sensors may be designed as gas/liquid detectors.

According to a further embodiment of the present invention the pump further comprises a non-return valve, also denoted as one way valve, arranged at the outlet of the chamber. The non-return valve is adapted to open after a predefined pressure is reached within the chamber. The non-return valve may be designed as a ball check valve, a diaphragm check valve or a tilting disc check valve. The non-return valve may open only to let coolant flow from the chamber of the pump to the sample vessel of the Dewar. The employing of a non-return valve is advantageous because the volume of tubing upward the non-return valve stays full of coolant between two pump strokes, thus making the pump more efficient.

According to a further embodiment of the present invention the pump further comprises a restrictor such as a throttle or a throttle valve. The restrictor is arranged at the outlet of the chamber. Therein, the restrictor is adapted to limit the flow of coolant through the outlet, facilitating the pressure increase within the chamber. The restrictor allows for the flow through the outlet to start immediately when the pressure increases. The restrictor limits the flow and makes possible the pressure increase in the chamber. The employing of a restrictor or throttle valve is advantageous due to its simplicity, reliability and low cost.

According to a second aspect of the present invention a Dewar vessel for storing samples in a coolant is provided. The Dewar vessel comprises a thermally insulated reservoir for the coolant, and a sample vessel arranged in the thermally insulated reservoir. Therein, the reservoir is provided separately from the sample vessel. In particular, the reservoir houses the sample vessel. The reservoir is connected to the sample vessel in such a way that the level of coolant is kept constant in the sample vessel.

In other words the idea of the present invention according to the second aspect is based on providing reliable cooling of samples which are arranged near the top or near an opening of the Dewar vessel by arranging an additional sample vessel in a coolant reservoir of the Dewar vessel and by supplying the sample vessel continuously with coolant from the reservoir.

Due to the design of the Dewar vessel it is possible to store samples close to the surface of the Dewar vessel and thus to make possible a short and easy access to the samples while keeping them at the necessary low temperature. Contrary to this, in common Dewar vessels samples have to be stored at the bottom of the reservoir to provide sufficient cooling.

The sample vessel may be placed near the top of the Dewar vessel above the coolant stored in the reservoir such that the level of coolant in the reservoir is independent from the level of coolant in the sample vessel. Particularly, the level of coolant in the reservoir is lower than the level of coolant in the sample vessel. In this way the samples are easily accessible and at the same time thermal losses in the reservoir are kept low.

Moreover, as ice-free coolant is permanently supplied to the sample vessel the samples may stay in an ice free environment even when manipulated at a high rate. The sample vessel may further comprise an overflow, ice draining ports and/or ice draining pipes for removing ice coming from new samples or from ambient air through the opening of the Dewar vessel. Thus, ice may be removed regularly without the necessity to heat or re-heat frequently and dry the Dewar vessel.

A further advantage of the Dewar vessel according to the present invention is the possibility to refill the system, i.e. the reservoir, with coolant without affecting the level of coolant in the sample vessel. For example, the reservoir may be refilled via a standard high hysteresis automatic Dewar refilling system.

The Dewar vessel may be adapted for storing samples such as for example frozen samples at an automated macromolecular X-ray crystallography synchrotrons beam line. The samples may be stored in a fluid coolant, preferably, in liquid nitrogen.

The Dewar vessel may comprise an outer casing and an inner container which is denoted as reservoir. The casing and/or the container may comprise metal and/or synthetic materials.

Between the outer casing and the reservoir is a vacuum layer which prevents an exchange of heat between the reservoir and the surroundings of the Dewar vessel. Thus, the reservoir is thermally insulated. Within the reservoir a separate vessel, namely the sample vessel, is provided. The sample vessel is arranged in an upper part of the reservoir. Therein, the sample vessel may be arranged above the level of coolant in the reservoir or partially immersed into the coolant. The sample vessel may also comprise metal and/or synthetic materials.

The reservoir is connected to the sample vessel in such a way that the level of coolant is constant in the sample vessel. I.e. coolant is continuously supplied from the reservoir to the sample vessel and overflows to compensate for the part of coolant which for example boils-off and to compensate the effect of samples removal. For this purpose, for example the pump described above may be employed.

The Dewar vessel may furthermore be provided with an overflow of coolant. I.e. to keep a constant level of coolant in the sample vessel, more coolant than necessary is supplied to the sample vessel. The excess coolant flows for example over the edge of the sample vessel back into the reservoir below. Thus, the Dewar vessel may also be denoted as an Edge Dewar vessel.

According to a further embodiment of the present invention the Dewar vessel further comprises an opening for accessing the sample vessel. The opening may be arranged in an upper part or on top of the Dewar vessel. Therein, the sample vessel is arranged in the vicinity of the opening. Furthermore, a cover may be provided to cover the opening.

According to a further embodiment of the present invention the Dewar vessel comprises a pump as described above. The pump is arranged within the reservoir. I.e. the pump is immersed into the coolant in the reservoir. Therein, the pump is adapted to continuously convey coolant from the reservoir into the sample vessel as described above. Furthermore, the outlet of the pump is connected via a line or via a pipe to the sample vessel. The pipe may be connected to the sample vessel in a lower or preferably in an upper region of the sample vessel.

According to a further embodiment of the present invention the Dewar vessel further comprises a particle filter for filtering ice. Therein, the filer is arranged at the inlet of the pump. The filter may have a large surface to allow for filtering by gravity (low pressure losses) even when significantly contaminated by ice. The filter ensures that only ice-free coolant is supplied to the sample vessel from the reservoir.

Ice may be introduced into the Dewar vessel by new samples or from contamination by the ambient air through the opening of the Dewar. From the sample vessel ice may be removed via the overflow and ice-draining ports and pipes into the reservoir. The filter makes sure that this ice stays in the reservoir and the samples stay in an ice-free environment. Moreover, the filter enables an ice-removing without the necessity to heat the Dewar vessel because the ice accumulates at the filter and the filter may be exchanged after a certain period of time.

According to a further embodiment of the present invention the Dewar vessel further comprises an ice draining port. The ice draining port is provided at a bottom of the sample vessel. Therein, the ice draining port is adapted to release ice accumulated at the bottom of the sample vessel into the reservoir. Through this ice draining port ice may be removed which has a higher density than the coolant. Ice which has a density lower than the density of the coolant may float on the coolant and may be removed automatically by the overflow over the edge of the sample vessel. Additionally or alternatively a pipe may be provided which comprises a first opening and a second opening. The first opening may be arranged at the level of the top of the sample vessel and the second opening may be arranged at a lower area, e.g. at the bottom of the sample vessel. High density ice may be drained out of the sample vessel by overflow, in the same way floating ice is drained out of the sample vessel except that it is driven by the coolant flow through the pipe from the opening set at the bottom of the sample vessel to the opening set at the edge of the sample vessel. The ice coming from the sample vessel will stay in the Dewar vessel, blocked by the filter.

According to a further embodiment of the present invention a one way valve, e.g. a non-return valve is arranged at the ice draining port. The one way valve is adapted to open when a predetermined amount of ice is accumulated at the bottom of the sample vessel. For example, the one way valve may open only if a predetermined weight or volume of ice is present. The valve may be actuated from the top of the Dewar by a pusher or by an additional control device. Therein, the valve may be actuated by the control device at predetermined intervals of time.

According to a third aspect of the present invention a method for producing a pump described above is provided. The method comprises: providing a chamber with an inlet and an outlet, which chamber is adapted to fill by gravity through the inlet; arranging a closing element in the chamber, which closing element is adapted to automatically close or almost close the chamber when it is filled by coolant; connecting a pressure increasing device to the chamber or arranging it in the chamber such that the pressure increasing device is adapted to increase the pressure within the chamber, after the chamber is closed, until the fluid is released through the outlet.

According to a forth aspect of the present invention a method for producing a Dewar vessel described above is provided. The method comprises: providing a thermally insulated reservoir for a coolant; providing a sample vessel separately from the thermally insulated reservoir; arranging the sample vessel within the thermally insulated reservoir; connecting the reservoir with the sample vessel in such a way that the level of coolant is kept constant in the sample vessel, e.g. via a pump.

It should be noted that while the pump is described as adapted for use with a Dewar vessel, it may also be used independently from a Dewar vessel. For example, the pump may be used for different fluids than coolants. In this case a piston pump may be used as the pressure increasing device. Moreover, while the Dewar vessel is described as adapted for use with a pump as described above, the Dewar vessel may be used independently, i.e. with different pumps.

Furthermore, it should be noted that features described in connection with the different devices and methods may be combined with each other. These and other aspects of the invention will be apparent from and elucidated with reference to the embodiments described hereinafter.

BRIEF DESCRIPTION OF THE DRAWINGS

Exemplary embodiments of the invention will be described in the following with reference to the following drawings.

DETAILED DESCRIPTION OF EMBODIMENTS

Figure 1:
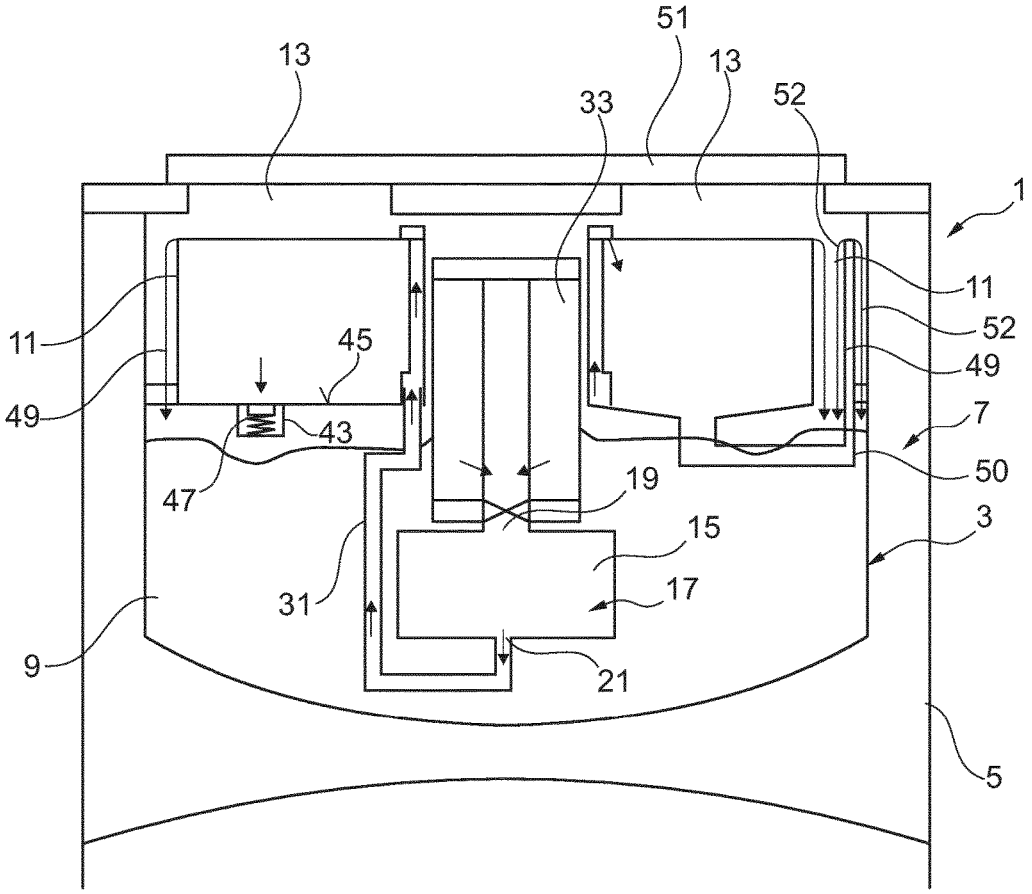
FIG. 1 shows a cross section of a Dewar vessel according to an embodiment of the invention

In FIG. 1 a Dewar vessel 1 is presented. The Dewar vessel 1 comprises a thermally insulated reservoir 3 for a coolant 9. The reservoir 3 is also denoted as buffer reservoir. A layer 7 of vacuum is provided between a casing 5 of the Dewar vessel 1 and the wall of the reservoir 3. The layer 7 of vacuum ensures that no heat is transferred between the environment around the Dewar vessel 1 and the reservoir 3. Thus, the reservoir 3 and in particular the coolant 9 within the reservoir 3 is thermally isolated.

Furthermore, a sample vessel 11 is arranged within the reservoir 3. In other words the reservoir 3 houses the sample vessel 11. As shown in FIG. 1 the sample vessel 11 is arranged above the level of coolant 9 in the reservoir 3. However, it is also possible that the sample vessel 11 is at least partially immersed into the coolant 9. The sample vessel 11 is adapted to accommodate and cool e.g. frozen samples. To allow short access and a high sample turnover the sample vessel 11 is arranged in the vicinity of or directly at an opening 13 of the Dewar vessel 13. The opening 13 may be provided with a cover 51. However, it is also possible to keep the Dewar vessel 1 according to the invention permanently open without significantly affecting the quality of the coolant 9 or the cooling temperature.

Moreover, the Dewar vessel 1 comprises a pump for automatically and continuously (in a pulsed regime) pumping coolant 9 from the reservoir 3 to the sample vessel 11. The pump 15 is preferably immersed into the coolant 9 in the reservoir 3 and comprises a chamber 17 with an inlet 19 and an outlet 21. The inlet 19 is connected to the volume of the reservoir 3 and the outlet 21 is connected via line 31 to the volume of the sample vessel 11. Furthermore, at the inlet 19 a particle filter 33 is provided. The filter 33 clears the coolant 9 which enters the pump 15 and subsequently the sample vessel 11 from ice which may come from new samples or from ambient air through the opening 13.

The pump 15 continuously injects ice-free coolant 9, particularly liquid nitrogen, into the sample vessel 11 such that the level of coolant 9 is kept constant in the sample vessel 11. The functionality of the pump is described in greater detail below with reference to FIG. 2.

At the upper edge of the sample vessel 11 an overflow 49 is provided. I.e. the pump 15 supplies more coolant 9 than necessary to fill the sample vessel 11. Thus, the excess coolant 9 flows over the edge of the sample vessel 11 back into the reservoir 3. For this purpose a pipe may be provided. The overflow 49 may also move ice which floats on the coolant 9 from the sample vessel 11 to the reservoir 3.

Moreover, at least one ice draining port 43 is provided at the bottom 45 of the sample vessel 11. This is shown on the left side of the sample vessel 11 in FIG. 1. At the ice draining port 43 a one-way valve 47 may be provided. The one-way valve 47 may open only at certain time intervals or if a certain amount of ice is accumulated on top of the one-way valve 47.

Additionally or alternatively, a pipe 50 for draining ice may be provided at the sample vessel 11. This is shown on the right side of the sample vessel 11 in FIG. 1. The pipe 50 comprises a first opening and a second opening. The bottom 45 of sample vessel 11 may be designed in a sloping manner, such that ice with a higher density than coolant 9 moves due to gravity to a first opening connected to the lowest point of the bottom 45. The second opening of the pipe 50 is arranged at the level of the edge of the sample vessel 11 such that high density ice may be drained out of the sample vessel 11 by overflow 52 at the second opening.

The Dewar vessel 1 may be adapted for sample storage at an automated macromolecular X-ray crystallography beamline. The sample vessel 11 shown in FIG. 1 comprises a circular shape, for example an O-shape shown in cross section. The filter 33 and the pump 15 are arranged in the middle of the circular sample vessel 11. However, different shapes of the sample vessel 11 are possible. For example, several separate sample vessels 11 may be provided within the reservoir 3. Moreover, the pump 15 and the filter 33 may be arranged differently within the reservoir 3. For example, the pump 15 and the filter 33 may be arranged directly at the side wall of the reservoir 3.

Due to the constant level of coolant 9 in the sample vessel 11 the Dewar vessel 1 according to the invention allows samples to be stored close to the surface near the opening 13. As the coolant 9 is stored deep within the Dewar vessel 1 below the sample vessel 3 the thermal losses in the reservoir 3 are kept at a minimum. Moreover, due to the filter 33, the overflow 49 and the ice draining port 43 the samples may stay in an ice free environment even when manipulated at a high rate. Furthermore, these components make it possible to remove ice from the Dewar vessel 1 without re-heating of the Dewar vessel 1, e.g. by exchanging the filter 33 in which the ice is accumulated. The Dewar vessel 1 may also advantageously remain permanently open without significantly affecting the quality of the coolant 9. Finally, the Dewar vessel 1, and particularly, the reservoir 3 may be refilled with coolant 9 without affecting the level of coolant 9 in the sample vessel 11.

In FIG. 2A to 2E different states of operation of the pump 15 are shown. The pump 15 comprises a chamber 17 immersed in coolant 9. The chamber 17 fills by gravity and subsequently ejects the coolant 9 via line 31 into the sample vessel 11. The sample vessel is shown schematically in FIG. 2A. The pressure for ejecting the coolant 9 from the chamber 17 is created by evaporation of a part of the coolant 9 situated in the chamber 17 or alternatively by injecting a volume of gaseous coolant such as gaseous nitrogen with an external piston pump 29 as shown in FIG. 2F.

As shown in FIG. 2A the pump 15 is designed as a static pump. I.e. the pump 15 has a simple design without complicated moving elements. The pump 15 comprises the chamber 17 with an inlet 19, also denoted as input port, and an outlet 21, also denoted as output port. In the embodiment shown, the inlet 19 is arranged at the top of the chamber 17 and the outlet 21 is arranged at the bottom of the chamber 17. The outlet 21 is closed by a non-return valve 39 as shown in FIG. 2A to 2E. Alternatively, as shown in FIG. 2F, the flow from the outlet 21 is restricted by a restrictor 41 such as a throttle valve.

Figure 2:
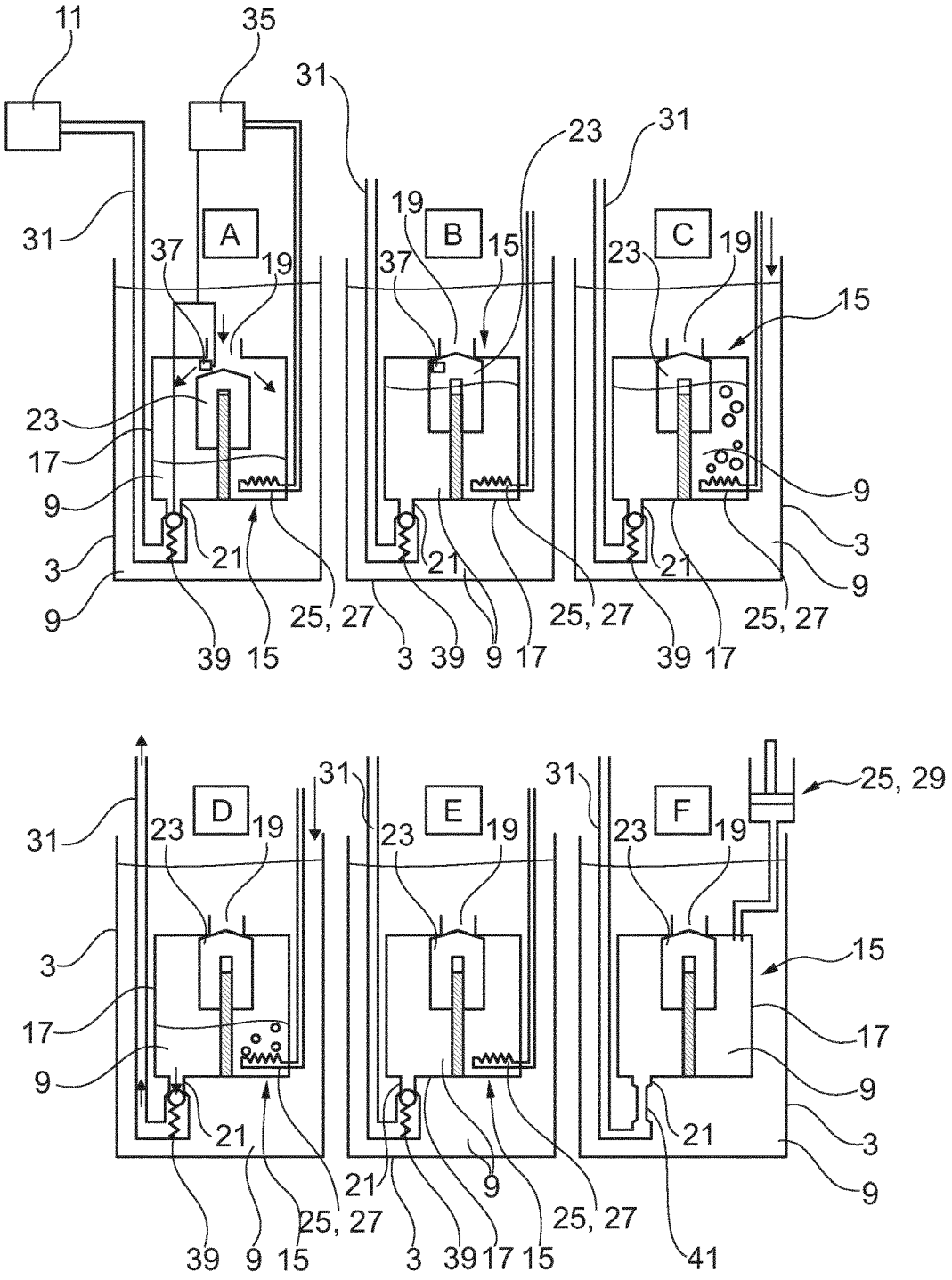
FIG. 2A to 2E show cross sections of a pump according to a further embodiment of the invention in different stages of a pump operation cycle
FIG. 2F shows a cross section of a further embodiment of the pump

The pump 15 further comprises a closing element 23 which e.g. has a lower density than the coolant 9 and therefore floats on top of the coolant 9. In FIG. 2 the closing element 23 is shown as a floating element. However, the closing element 23 may also be designed as a large surface non-return valve possibly with a low force spring connected to the bottom of the chamber 17. The closing element 23 may be arranged at a guide or rail which guides the closing element 23 to the inlet 19. Moreover, a pressure increasing element 25 is provided which may increase the pressure within the chamber 17 and in this way to eject the coolant 9 into the sample vessel 11. In the embodiment shown in FIG. 2A to 2E the pressure increasing device 25 is designed as a resistor 27, in particular as a wire with a high resistance. The resistor 27 is arranged in the pump 15 in direct contact with the coolant 9 within the chamber 17. Alternatively, the pressure increasing device 25 is designed as a piston pump 29 as shown in FIG. 2F. The piston pump 29 may be arranged inside or outside the Dewar vessel 1 and may be connected to the chamber 17 via a tube for delivering gaseous coolant.

Furthermore, a control device 35 connected to the pump is provided in the Dewar vessel 1. The control device 35 is shown only schematically in FIG. 2A. The control device 35 may be electrically or functionally connected by wires or wirelessly to components of the pump 15.

For example, the control device 35 may be connected to the pressure increasing device 25 in order to activate or to actuate the pressure increasing device 25 at the right moment. Moreover, the control device 35 may be connected to the non-return valve 39 or to the restrictor 41 for opening the access to the sample vessel 11 at the right moment.

Also, the control device 35 may be connected to a fill level sensor 37. The fill level sensor 37 may be optionally arranged within the chamber for determining a fill level of coolant 9 in the chamber 17. The fill level sensor 37 may be arranged at or in the vicinity of the inlet 19 as shown in FIG. 2A. Alternatively, the fill level sensor 37 may be included or integrated into the closing element 23 as shown in FIG. 2B. Furthermore, the control device 35 may comprise an energy source or be connected to an energy source. Moreover, the control device 35 may comprise a memory on which predefined values e.g. for necessary fill levels of the chamber 17 are stored.

In the following the functionality or operation of the pump 15 is explained. As shown in FIG. 2A, chamber 17 automatically fills by gravity flow through the inlet 19. This happens during a thermal equilibrium time, i.e. while the pressure inside and outside the chamber 17 equilibrate.

As shown in FIG. 2B the closing element 23 closes the inlet 19 as soon as the chamber 17 is full with coolant 9 or alternatively if a certain amount of coolant 9 is in the chamber 17. The control device 35 (not shown in FIG. 2B) determines or detects that that the chamber 17 is filled with coolant 9. This may for example take place by a fill level sensor or a contact sensor which transmits a corresponding signal to the control device 35. Alternatively, the control device 35 determines that the chamber 17 is filled based on a certain amount of time which passed since the last pumping cycle.

FIG. 2C shows the next operational step of the pumping cycle. After the chamber 17 is filled with coolant 9 and closed by the closing element 23, the pressure increasing device 25 is activated by the control device 35. In the embodiment of FIG. 2C the pressure increasing device is a resistor 27 which is supplied with electric power via the control device 35. At the resistor 27 the electric power is partially transformed into heat and transferred to the coolant 9 within the closed chamber 17. This results in evaporating of a part of the coolant 9 in the chamber 17 which leads to an increase in pressure.

FIG. 2F shows an alternative to the increase of pressure within the chamber 17. According to the embodiment in FIG. 2F the pressure is increased via a piston pump 29 which presses gaseous coolant 9 or any other gaseous substance into the chamber 17. Therein, the piston pump 29 may fill with gaseous coolant aspirated from the chamber 17 in an aspiration phase.

When the pressure within the chamber 17 reaches a predetermined level the non-return valve 39 at the outlet 21 of the chamber 17 opens and the coolant 9 is expulsed via line 31 into the sample vessel 11. In the alternative embodiment shown in FIG. 2F the non-return valve 29 is replaced by a restrictor 41. In a further alternative line 31 may replace the functionality of a restrictor 41 by creating sufficient load. In the case of a restrictor 41 flow of coolant through the outlet 21 starts immediately when the pressure increases. However, the restrictor 41 limits the flow and makes possible the pressure increase in the chamber 17. After the pressure in the chamber 17 reaches the predetermined value, the coolant 9 flows fast through the restricted tubing shown in FIG. 2F. The pressure increase is fast enough for the inlet 19 to remain closed until most of the coolant 9 is ejected from the outlet 21. In particular, in the embodiment of FIG. 2C the heat may be provided in a flash.

As shown in FIG. 2E, the equilibrium is reached after the emptying of the coolant 9 form the chamber 17 and the closing element 23 falls due to gravity as shown in FIG. 2A again. Thus, the inlet 19 is open and the chamber 17 fills again by gravity with coolant 9. In this way the next cycle of the operation starts. Therein, the pump 15 functions in a pseudo volumetric way. I.e. the amount of coolant 9 delivered in each cycle of operation to the sample vessel 11 is approximately the same and corresponds to the volume of the chamber 17. The volume expulsed can also be controlled by the amount of heat or volume of gas provided in the chamber. Furthermore, the pump 15 is advantageously simple and therefore does not require a lot of maintenance. Furthermore, the connection of the pump 15 to the external world is limited to a few electrical wires or to a pneumatic tube.

It has to be noted that embodiments of the invention are described with reference to different subject matters. In particular, some embodiments are described with reference to method type claims whereas other embodiments are described with reference to the device or system type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

Furthermore, the term "comprising" does not exclude other elements or steps, and the indefinite article "a" or "an" does not exclude a plurality. The mere fact that certain measures are re-cited in mutually different dependent claims does not indicate that a combination of these measures cannot be used to advantage. Any reference signs in the claims should not be construed as limiting the scope.

LIST OF REFERENCE SIGNS

1 Dewar vessel
3 thermally insulated reservoir
5 casing
7 layer of vacuum
9 coolant (liquid nitrogen)
11 sample vessel
13 opening of the Dewar vessel
15 pump
17 chamber
19 inlet
21 outlet
23 closing element (e.g. floating element or non-return valve)
25 pressure increasing device
27 resistor
29 piston pump
31 line
33 particle filter
35 control device
37 fill level sensor
39 first non-return valve (of the pump)
41 restrictor (throttle valve)
43 ice draining port
45 bottom of sample vessel
47 second one-way valve (at the sample vessel)

49 overflow from sample vessel
50 pipe
51 cover
52 overflow from pipe

The invention claimed is:

1. Dewar vessel for storing samples in a coolant, the Dewar vessel comprising a pump for pumping the coolant within the Dewar vessel, the pump comprising:
a chamber with an inlet and an outlet;
a closing element;
a pressure increasing device;
wherein the inlet of the chamber is connected to a reservoir of the Dewar vessel;
wherein the chamber is adapted to fill with coolant through the inlet such that the coolant flows downward by gravity into the chamber;
wherein the closing element is adapted to automatically close the chamber by floating when chamber is filled by the coolant;
wherein the pressure increasing device is adapted to increase a pressure within the chamber, after the chamber is filled with coolant, until the coolant is released through the outlet;
a thermally insulated reservoir for the coolant;
a sample vessel arranged in the thermally insulated reservoir;
wherein the reservoir is provided separately from the sample vessel;
wherein the reservoir is connected with the sample vessel in such a way that the level of coolant is constant in the sample vessel;
wherein the pump is arranged in the reservoir; and
wherein the pump is adapted to continuously, in a pulsed regime, convey coolant from the reservoir into the sample vessel.

2. Dewar vessel according to claim 1, further comprising
an opening for accessing the sample vessel;
wherein the sample vessel is arranged in the vicinity of the opening.

3. Dewar vessel according to claim 1,
wherein the pump is immersed in the coolant in the reservoir;
wherein the outlet of the pump is connected via a line to the sample vessel.

4. Dewar vessel according to claim 1, further comprising
a particle filter for filtering ice;
wherein the filter is arranged at the inlet of the pump.

5. Dewar vessel according to claim 1, further comprising
an ice draining port;
wherein the ice draining port is provided at a bottom of the sample vessel;
wherein the ice draining port is adapted to release ice accumulated at the bottom of the sample vessel into the reservoir.

6. Dewar vessel according to claim 5,
wherein a one way valve is arranged at the ice draining port;
wherein the one way valve is adapted to open when a predetermined amount of ice is accumulated at the bottom of the sample vessel; and/or
wherein the one way valve is adapted to open after a predetermined amount of time.

7. Method for producing a Dewar vessel, the method comprising the following steps:
providing a thermally insulated reservoir for a coolant;
providing a sample vessel separately from the thermally insulated reservoir;
providing a pump for pumping the coolant within the Dewar vessel, the pump comprising:
a chamber with an inlet and an outlet;
a closing element;
a pressure increasing device:
wherein the inlet of the chamber is connectable to a reservoir of the Dewar vessel;
wherein the chamber is adapted to fill with coolant through the inlet such that the coolant flows downward by gravity into the chamber;
wherein the closing element is adapted to automatically close the chamber by floating when chamber is filled by the coolant;
wherein the pressure increasing device is adapted to increase a pressure within the chamber, after the chamber is filled with coolant, until the coolant is released through the outlet:
arranging the sample vessel within the thermally insulated reservoir;
arranging the pump in the reservoir;
connecting the reservoir with the sample vessel in such a way that the level of coolant is kept constant in the sample vessel.

* * * * *